US011571609B2

(12) United States Patent
Kimura

(10) Patent No.: US 11,571,609 B2
(45) Date of Patent: Feb. 7, 2023

(54) BALANCE TRAINING SYSTEM AND CONTROL PROGRAM FOR BALANCE TRAINING SYSTEM

(71) Applicant: Toyota Jidosha Kabushiki Kaisha, Toyota (JP)

(72) Inventor: Akihiro Kimura, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 540 days.

(21) Appl. No.: 16/810,194

(22) Filed: Mar. 5, 2020

(65) Prior Publication Data

US 2020/0289897 A1 Sep. 17, 2020

(30) Foreign Application Priority Data

Mar. 15, 2019 (JP) ..... JP2019-047888

(51) Int. Cl.
*A63B 26/00* (2006.01)
*A61H 1/00* (2006.01)

(52) U.S. Cl.
CPC ..... *A63B 26/003* (2013.01); *A61H 1/001* (2013.01); *A61H 1/005* (2013.01); (Continued)

(58) Field of Classification Search
CPC ..... A63B 26/003; A63B 71/0622; A63B 2071/025; A63B 24/0087; A63B 2024/0096; A63B 2071/0638; A63B 2071/0647; A63B 2071/0675; A63B 2220/40; A63B 2220/52; A63B 2220/833; A63B 2225/02; A63B 2225/50; A63B 23/08; A63B 71/0619; A63B 2071/0658; A63B 22/16; A63B 22/18; A61H 1/001; A61H 1/005; A61H 2201/1635; A61H 2201/1669; A61H 2201/5043; A61H 2201/5071; A61H 2203/0406; A61H 2203/625; A61H 1/00; A61H 2201/01308
See application file for complete search history.

(56) References Cited

U.S. PATENT DOCUMENTS 8,131,498 B1 * 3/2012 McCauley ..... A61B 5/1036 177/144
10,159,872 B2 * 12/2018 Sasaki ..... A63B 22/16
2018/0289579 A1 * 10/2018 Agrawal ..... A61B 5/112

FOREIGN PATENT DOCUMENTS

JP 2015-100477 A 6/2015

* cited by examiner

*Primary Examiner* — Timothy A Stanis
*Assistant Examiner* — Matthew R Moon
(74) *Attorney, Agent, or Firm* — Dinsmore & Shohl LLP

(57) ABSTRACT

A balance training system includes a moving carriage moving on a moving surface by driving a driving unit, and calculates a load's center of gravity of the training person's feet on a boarding surface from the detected load. The system sets a stable range. The stable range is a range of the load's center. The training person is estimated to maintain upright on the boarding surface in the range. The system controls movement of the moving carriage in a mode selected between a first mode and a second mode. In the first mode, the driving unit drives under drive control predicting that the calculated load's center shifts within a first range set inside the stable range. In in the second mode, the driving unit drives under drive control predicting that the calculated load's center shifts to a second range set outside the first range inside the stable range.

8 Claims, 9 Drawing Sheets

(52) U.S. Cl.
CPC ..... *A61H 2201/1635* (2013.01); *A61H 2201/1669* (2013.01); *A61H 2201/5043* (2013.01); *A61H 2201/5071* (2013.01); *A61H 2203/0406* (2013.01); *A61H 2230/625* (2013.01)

BALANCE TRAINING SYSTEM AND CONTROL PROGRAM FOR BALANCE TRAINING SYSTEM

CROSS REFERENCE TO RELATED APPLICATIONS

This application is based upon and claims the benefit of priority from Japanese patent application No. 2019-047888, filed on Mar. 15, 2019, the disclosure of which is incorporated herein in its entirety by reference.

BACKGROUND

The present disclosure relates to a balance training system and a control program for the balance training system.

A training apparatus for a patient with a disability in his/her leg to perform rehabilitation training is becoming widespread. For example, a training apparatus that moves a footboard with driving means in order to make a training person who performs training stand on the footboard and observe a center of gravity position, and to encourage the training person to take a step or prevent the training person from falling is known (for example, see Japanese Unexamined Patent Application Publication No. 2015-100477).

SUMMARY

In a configuration in which a footboard moves by a small amount relative to the training apparatus, the training person basically maintains a state in which he/she stands upright with respect to a floor surface, which makes it difficult to maintain the training person's motivation due to poor changes in environment during training. When game characteristics are given to a training attempt, the greater the bodily sensation achieved in association with a game, the greater the training person is motivated to take part in the training attempt. It has been found that a configuration in which a moving carriage is provided in a balance training apparatus and the entire balance training apparatus moves while a training person is on board is effective for rehabilitation training. However, when the balance training apparatus is moved at random, a training effect achieved by the training attempt becomes uncertain, and it becomes unclear whether appropriate training is performed according to a progress of rehabilitation training and a training person's condition at that time.

The present disclosure has been made to solve such a problem. An object of the present disclosure is to provide a balance training system and the like that allow a training person having a disease in his/her balance function to perform appropriate rehabilitation training in order to recover the balance function.

A first example aspect is a balance training system including: a moving carriage configured to be able to move on a moving surface by driving a driving unit; a detection unit configured to detect a load received from a training person's feet standing on the moving carriage; a calculation unit configured to calculate a load's center of gravity of the training person's feet on a boarding surface from the load detected by the detection unit; a setting unit configured to set a stable range, the stable range being a range of the load's center of gravity, and the training person is estimated to maintain upright on the boarding surface in the range; and a control unit configured to drive the driving unit and control movement of the moving carriage in a mode selected between a first mode and a second mode, in the first mode, the driving unit being driven under drive control predicting that the load's center of gravity calculated by the calculation unit shifts within a first range set inside the stable range, and in the second mode, the driving unit being driven under drive control predicting that the load's center of gravity calculated by the calculation unit shifts to a second range set outside the first range inside the stable range.

It has been found that the balance function is classified into two categories. One function is to keep a natural standing posture so that the training person does not wobble due to an unexpected disturbance stimulus, and the other function is to return the posture of the training person to the natural standing posture after he/she is caused to wobble by a strong disturbance stimulus. Depending on the condition of the training person's disease and the progress of rehabilitation training of the training person, one of the above-mentioned two functions may be recovering while the other function is not recovering. The above-described balance training system provides the first mode for recovering the function of keeping the natural standing posture so that the training person does not wobble due to the unexpected disturbance stimulus and the second mode for recovering the function of returning the posture of the training person to the natural standing posture after he/she is caused to wobble by the strong disturbance stimulus. Thus, the training person can perform appropriate rehabilitation training according to the purpose.

In the above rehabilitation training system, at least one of a magnitude of acceleration and an acceleration time applied to the moving carriage in the drive control in the first mode may be set to be different from corresponding one of a magnitude of acceleration and an acceleration time applied to the moving carriage in the drive control in the second mode. Disturbance stimuli that require the balance function to work are mainly caused by acceleration applied to the foot. Thus, a disturbance stimulus suitable for each mode can be generated by controlling the magnitude of the acceleration and the acceleration time generated in the moving carriage.

Further, when the load's center of gravity calculated by the calculation unit deviates from the first range while the control unit drives the driving unit in the first mode, the control unit may narrow the first range to correct the drive control. Likewise, when the load's center of gravity calculated by the calculation unit deviates from the second range while the control unit drives the driving unit in the second mode, the control unit may narrow the second range to correct the drive control. When the load's center of gravity of t calculated during training deviates from the planned range, the drive control may be corrected in this manner to effectively prevent disturbance stimulus, so that a targeted rehabilitation effect can be sufficiently achieved.

The above rehabilitation training system may further include a selection unit configured to select one of the first mode and the second mode prior to a training attempt. With such a selection unit, the training person can not only perform a training attempt in accordance with a preset rehabilitation training but also perform rehabilitation training according to his/her condition of the day and mood of the day.

Further, the setting unit may set the stable range based on the load's center of gravity calculated by the calculation unit in a calibration work performed by the training person prior to the training attempt. Since the stable range can change depending on the progress of the rehabilitation training of the training person, the training person's condition at that time, etc., calibration may be performed prior to the training attempt.

A second example aspect is a control program for a balance training system for enabling a training person to perform balance training while standing on a moving carriage moving on a moving surface. The control program causes a computer to execute: setting a stable range, the stable range being a range of a load's center of gravity, and the training person is estimated to maintain upright on the boarding surface in the range; and when the moving carriage is moved by driving a driving unit, driving the driving unit and controlling movement of the moving carriage in a mode selected between a first mode and a second mode, in the first mode, the driving unit being driven under drive control predicting the load's center of gravity shifts within a first range set inside the stable range, and in the second mode, the driving unit being driven under drive control predicting the load's center of gravity shifts to a second range set outside the first range within the stable range. With the balance training system controlled by such a control program, the training person can perform rehabilitation training according to the purpose, as discussed above.

According to the present disclosure, it is possible to provide a balance training system and the like that allow a training person having a disease in his/her balance function to perform appropriate rehabilitation training in order to recover the balance function.

The above and other objects, features and advantages of the present disclosure will become more fully understood from the detailed description given hereinbelow and the accompanying drawings which are given by way of illustration only, and thus are not to be considered as limiting the present disclosure.

DETAILED DESCRIPTION

Hereinafter, the present disclosure will be described through embodiments of the disclosure, but the disclosure according to the claims is not limited to the following embodiments. Further, all of the configurations described in the embodiments are not necessarily essential as means for solving the problem.

Figure 1:
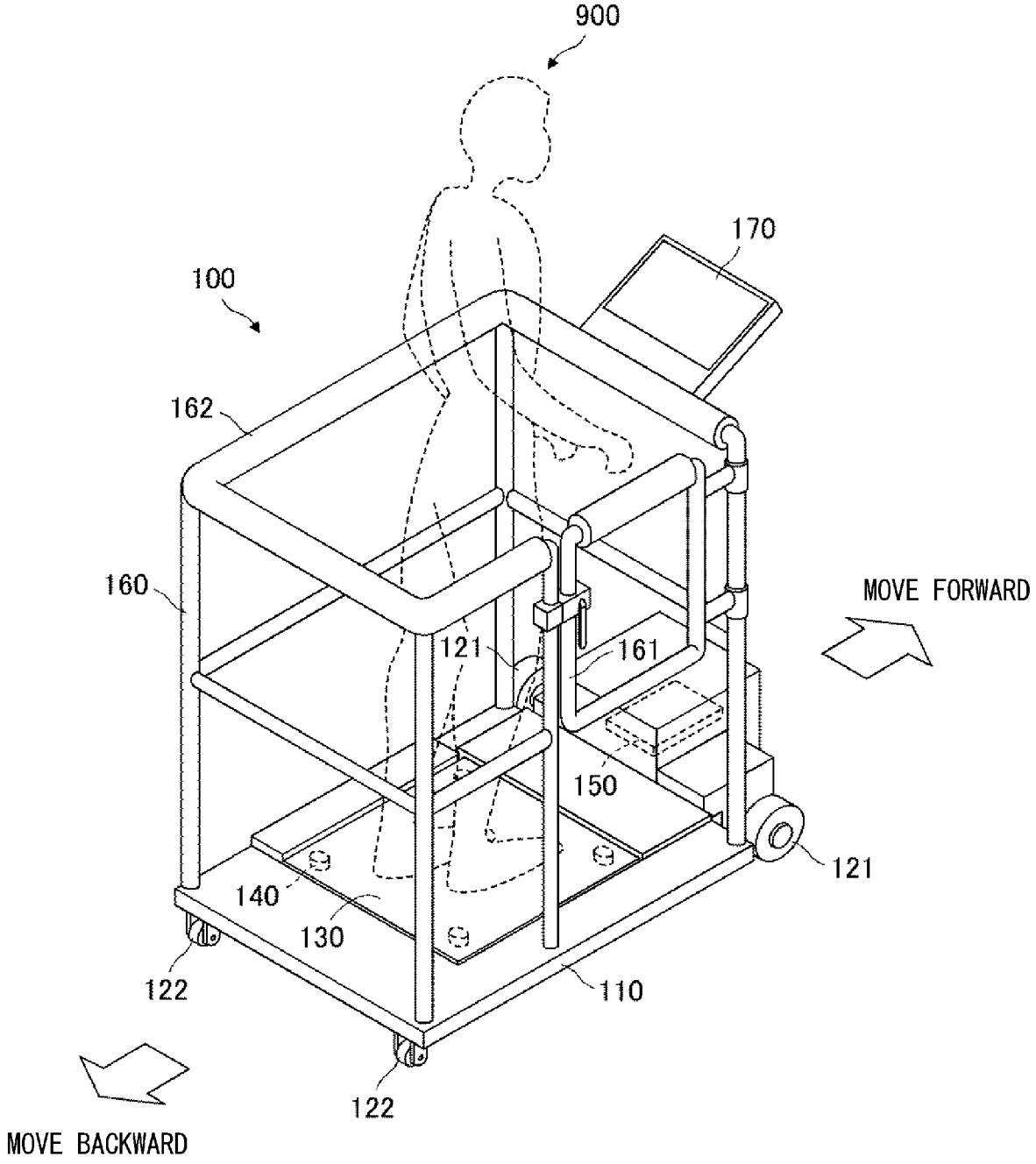
FIG. 1 is a schematic perspective view of a balance training apparatus according to an embodiment.

FIG. 1 is a schematic perspective view of a training apparatus 100 as an example of a balance training apparatus according to this embodiment. The training apparatus 100 is an apparatus for a disabled person with a disability such as hemiplegia to learn to shift his/her center of gravity which is necessary for walking, or for a patient with a disability in his/her ankle joint to recover the ankle joint function. For example, when a training person 900 who wants to recover the ankle joint function tries to continue boarding the training apparatus 100 while maintaining his/her balance, the training apparatus 100 can apply a load that can expect a rehabilitation effect to the training person 900's ankle joint.

The training apparatus 100 includes a moving carriage 110 and a frame 160. The moving carriage 110 is able to move in a front-rear direction on a moving surface that is a floor surface or the like of a rehabilitation facility. The frame 160 is provided to stand on the moving carriage 110 and prevents the training person 900 boarding the moving carriage 110 from falling. The moving carriage 110 mainly includes driving wheels 121, casters 122, a boarding plate 130, load sensors 140, and a control box 150.

The driving wheels 121 are arranged as two front wheels with respect to a traveling direction. Each driving wheel 121 is rotationally driven by a motor (not shown) as a driving unit, and moves the moving carriage 110 forward or backward. The casters 122 are driven wheels and are arranged as two rear wheels with respect to the traveling direction. The boarding plate 130 is a boarding unit on which the training person 900 boards and places his/her feet. A flat plate made of, for example, a polycarbonate resin with a relatively high rigidity that can withstand the boarding of the training person 900 is used as the boarding plate 130. The boarding plate 130 is supported on an upper surface of the moving carriage 110 with the load sensors 140 disposed at four corners interposed therebetween.

Each of the load sensors 140 is, for example, a load cell, and functions as a detection unit that detects a load received from the training person 900's feet standing on the moving carriage 110. The control box 150 accommodates an arithmetic processing unit and a memory, which will be described later.

The frame 160 includes an opening and closing door 161 and a handrail 162. The opening and closing door 161 is opened when the training person 900 boards the boarding plate 130 to form a passage for the training person 900. The opening and closing door 161 is closed and locked when the training person 900 performs a training attempt. The handrail 162 is provided to surround the training person 900 so that it can be grasped when the training person 900 is about to lose his/her balance or feels uneasy. Note that when the training person 900 performs a training attempt, he/she tries to maintain an upright posture by maintaining his/her balance by himself/herself without grasping the handrail 162. The frame 160 supports a display panel 170. The display panel 170 is a display unit that is, for example, a liquid crystal panel. The display panel 170 is disposed at a position where the training person 900 can easily see during the training attempt.

Figure 2:
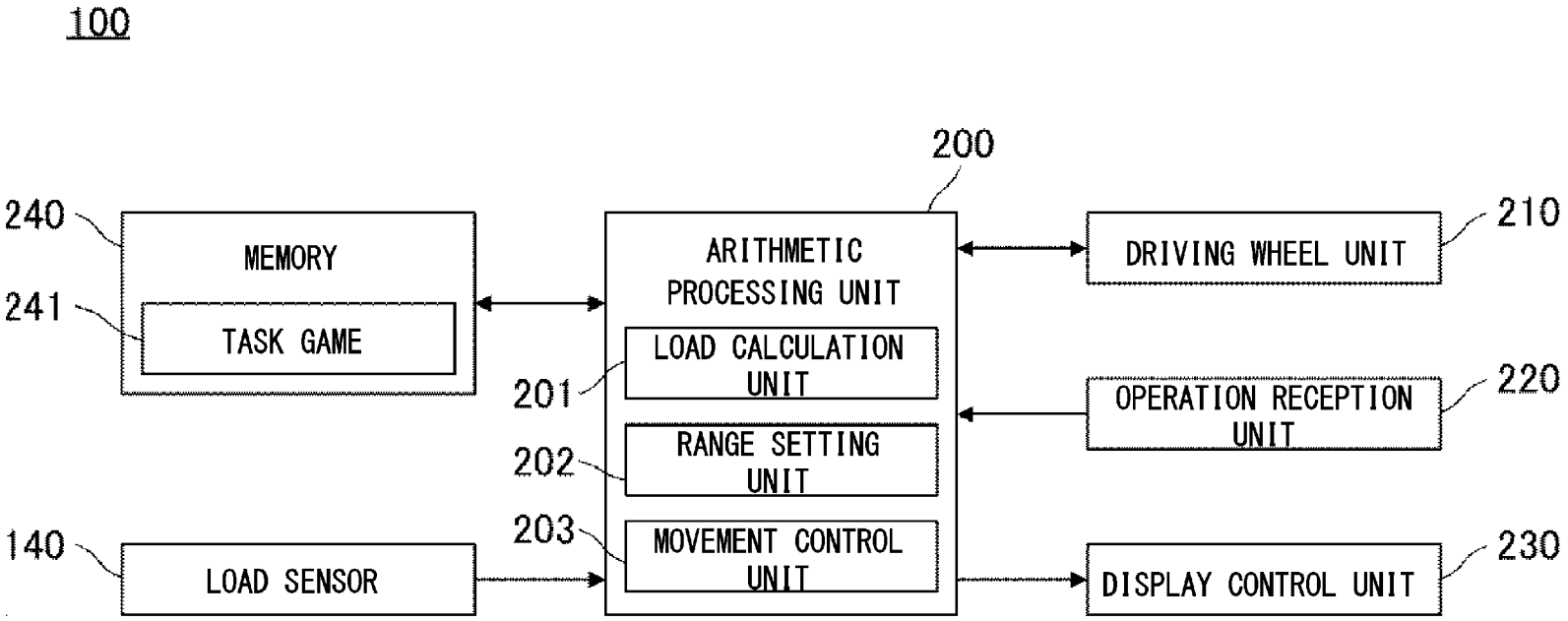
FIG. 2 shows a system configuration of the balance training apparatus.

FIG. 2 shows a system configuration of the training apparatus 100. An arithmetic processing unit 200 is, for example, an MPU and performs control of the entire apparatus by executing a control program read from a memory 240. A driving wheel unit 210 is an example of a driving mechanism and includes a driving circuit and a motor for driving the driving wheels 121. The driving wheel unit 210 includes a rotary encoder that detects an amount of rotation of the driving wheels 121.

An operation reception unit 220 receives input operations from the training person 900 and an operator, and transmits an operation signal to the arithmetic processing unit 200. The training person 900 or the operator operates an operation button provided on the apparatus, a touch panel superimposed on the display panel 170, an attached remote controller, or the like, which constitute the operation reception unit 220, in order to give an instruction for turning on and off the power and for starting a training attempt, to enter numerical values for setting, and to select menu items.

A display control unit 230 generates a graphic video image and the like of a task game, which will be described later, in accordance with a display signal from the arithmetic processing unit 200, and displays the graphic video image and the like on the display panel 170. The memory 240 is a non-volatile storage medium. For example, a solid state drive is used as the memory 240. The memory 240 stores a control program and so on for controlling the training apparatus 100. The memory 240 further stores various parameter values, functions, lookup tables and so on used for control. In particular, the memory 240 stores a task game 241 that is a program for giving a task in a game format so that the training person 900 can enjoy a training attempt. The load sensors 140 detect loads applied from the training person 900's feet via the boarding plate 130, and transmit detection signals to the arithmetic processing unit 200.

The arithmetic processing unit 200 also serves as a function execution unit that performs various calculations and control of individual elements in accordance with a request of the control program. A load calculation unit 201 acquires the detection signals of the four load sensors 140 and calculates a load's center of gravity of the training person 900's feet on the boarding surface. Specifically, since the respective positions of the four load sensors 140 are known, the center of gravity position is calculated from the distribution of the loads in the vertical direction detected by the respective load sensors 140, and the center of gravity position is used as the load's center of gravity. The load's center of gravity is calculated as the center of gravity position of a load distribution in this way, and thus the load's center of gravity can also be regarded as a center of foot pressure applied to the boarding surface by the training person 900's feet.

A range setting unit 202 sets a stable range that is a range of the load's center of gravity estimated that the training person 900 can maintain upright on the boarding surface. A specific setting method will be described later. A movement control unit 203 generates a driving signal to be transmitted to the driving wheel unit 210, and controls the movement of the moving carriage 110 via the driving wheel unit 210. In this embodiment, in particular, the movement control unit 203 controls the movement of the moving carriage 110 in accordance with a mode selected between a first mode and a second mode. Each of the first and second modes is characterized by a moving operation of the moving carriage 110. Details of the first mode and the second mode will be described later.

The arithmetic processing unit 200 may be composed of one or more processors. The load calculation unit 201, the range setting unit 202, and the movement control unit 203 may be composed of one or more processors. Alternatively, the load calculation unit 201, the range setting unit 202, the movement control unit 203, and the display control unit 230 may be composed of one or more processors.

Figure 3:
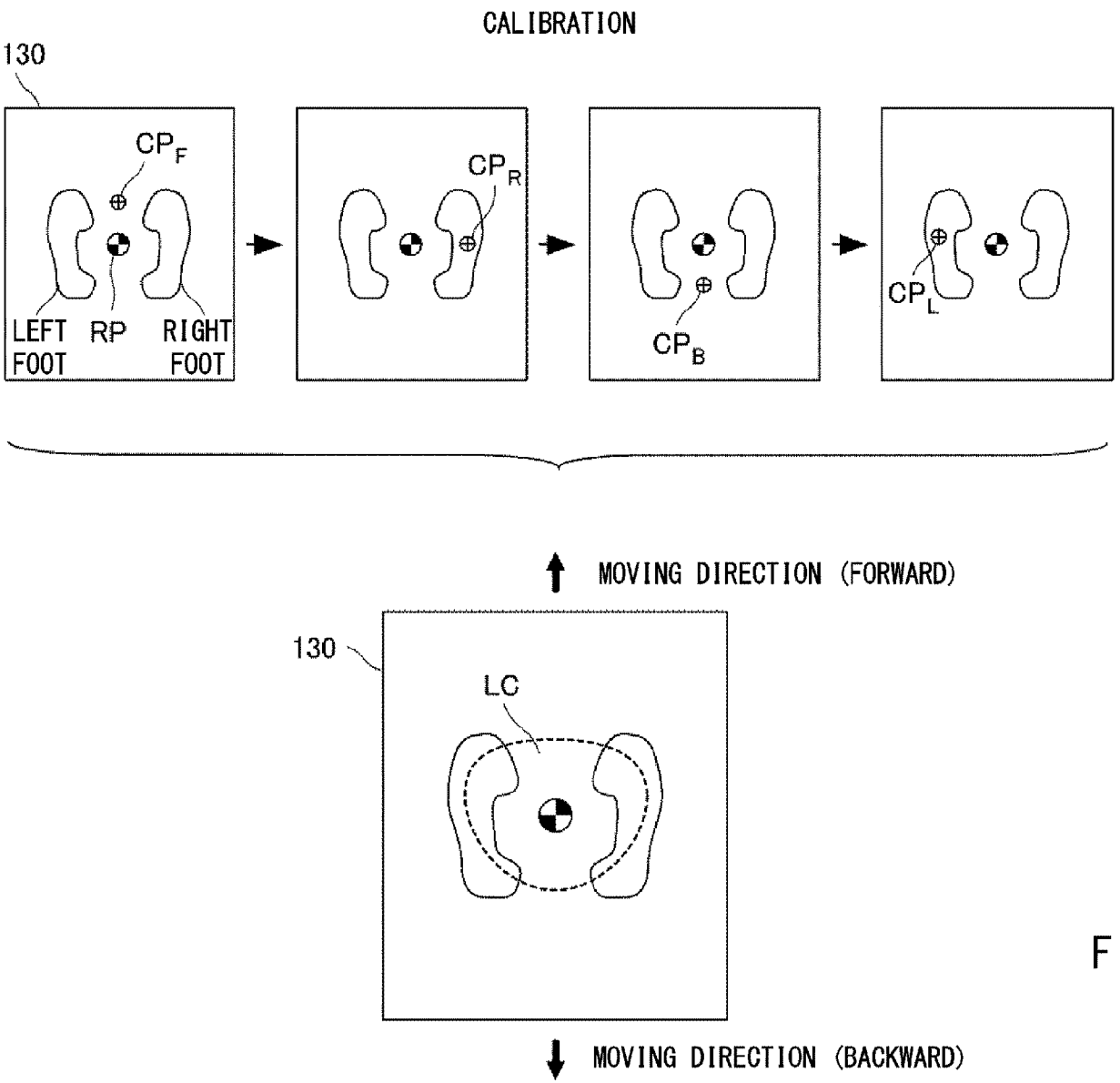
FIG. 3 is a diagram for explaining a setting of a stable range.

FIG. 3 is a diagram for explaining the setting of the stable range. The range setting unit 202 sets a stable range through a calibration work performed by the training person 900 prior to a training attempt. In the calibration work, the training person 900 stands on the boarding surface of the boarding plate 130 with a natural as possible standing posture so that the reference position RP determined with respect to the boarding surface is positioned at a midpoint between the feet. Then, in the order shown in the upper diagram of FIG. 3, while the training person 900 maintains the standing posture, the training person 900 shifts his/her center of gravity forward until right before the heels of the feet are lifted in the air, and then shifts his/her center of gravity on the right foot until right before the left foot is lifted in the air, and then shifts his/her center of gravity backward until right before the toes of the feet are lifted in the air, and lastly shifts his/her center of gravity on the left foot until right before the right foot is lifted in the air. As shown in the drawing, the load calculation unit 201 calculates each load's center of gravity $CP_F$, $CP_R$, $CP_B$, and $CP_L$ for each shift in the center of gravity.

The range setting unit 202 fits a smooth closed curve so as to pass through each load's center of gravity $CP_F$, $CP_R$, $CP_B$, and $CP_L$ calculated in this manner, and sets a range surrounded by the closed curve as a stable range LC. The stable range LC set in this way is a range in which the training person 900 is expected to be able to maintain a standing state by adjusting his/her balance while the load's center of gravity of the training person 900 is included in this range. The stable range LC may be set by selecting, from a preset lookup table, a stable range corresponding to the training person 900's height, weight, foot size, a progress of rehabilitation training, etc., in addition to the stable range LC being set through a calibration work.

In this embodiment, the training person 900 is encouraged to perform training by carrying out the task game 241. The task game 241 processed by the arithmetic processing unit 200 generates a graphic video image that changes every moment in association with the movement of the training apparatus 100 displays the graphic video image on the display panel 170. The training person 900 tries to maintain a standing posture on the boarding plate 130 without changing the standing position.

Figure 4A:
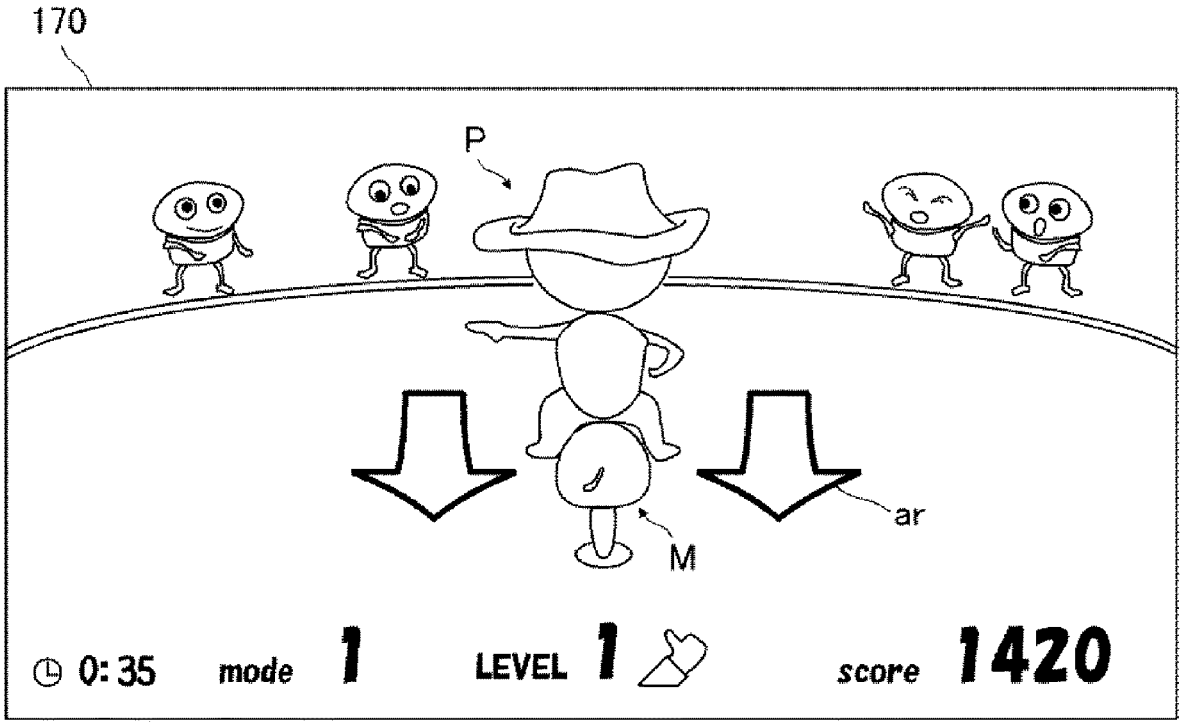
FIG. 4A shows a game screen at the time of starting a training attempt.
Figure 4B:
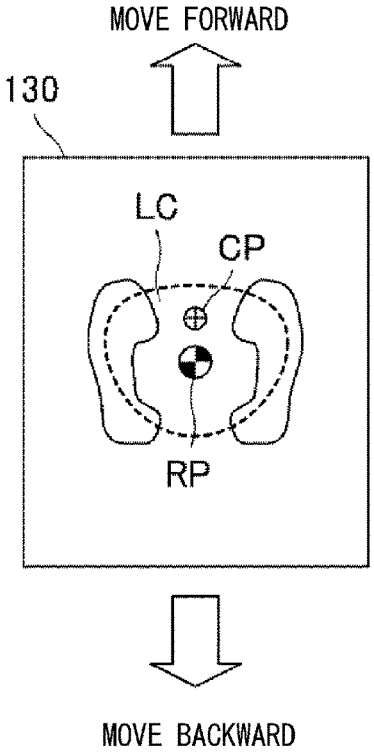
FIG. 4B shows a load's center of gravity of a training person.

FIG. 4A shows a game screen at the time of starting a training attempt, and FIG. 4B shows a load's center of gravity of the training person 900 at that time. The game screen is a video image displayed on the display panel 170, and shows that a game with a rodeo concept is selected from among a plurality of task games 241 and then carried out.

A character M designed as a stray horse is displayed at the center of a stadium superimposed on a background image. Further, a character P designed as a cowboy is displayed mounting the character M. The character M represents the moving carriage 110, and the character P represents the training person 900. Since the display panel 170 is installed in front of the training person 900, the characters M and P are displayed with their backs facing the training person 900. The game screen also displays information such as a selected game mode, a score that changes according to the status of the game, the elapsed time, and so on.

The character M swings back and forth in accordance with a progress of the task game 241. The arrows ar in the drawing supplementarily show the directions and magnitudes of the swinging so that the training person 900 can easily recognize the swinging of the character M. The movement control unit 203 moves the moving carriage 110 forward or backward in synchronization with the swinging of the character M. When the moving carriage 110 is moved forward or backward, the training person 900 plants his/her feet on the boarding plate 130 to maintain a standing posture, and the calculated load's center of gravity CP moves every moment as shown in FIG. 4B.

When the load's center of gravity CP is positioned within the stable range LC, it can be estimated that the training person 900 can maintain a standing posture without changing his/her step. On the contrary, when the load's center of gravity CP deviates from the stable range LC, it can be estimated that the training person 900 has changed his/her step or grabbed the handrail 162. When the training person 900 can maintain the standing posture without changing his/her step, he/she can adjust his/her balance by tilting his/her center of gravity, which is effective as training for recovering the balance function. When the training person 900 changes his/her step or grabs the handrail 162, the training person 900 is not able to handle the movement of the moving carriage 110 by his/her own balance adjustment. Thus, in such a case, it can be said that the training is not preferable for recovering the balance function.

It has been found that the balance function is classified into two categories. One function is to keep the posture so that the training person does not wobble due to an unexpected disturbance stimulus, and the other function is to return the posture of the training person to a natural standing posture after he/she is caused to wobble by a strong disturbance stimulus. In order to recover the above-mentioned function of keeping the posture so that the training person does not wobble due to the unexpected disturbance stimulus, the training person may continuously receive a relatively small disturbance stimulus and performs training in which his/her center of gravity is finely changed in response to the disturbance stimuli. In order to recover the above-mentioned function of returning the posture of the training person after he/she is caused to wobble due to the strong disturbance stimulus, the training person may receive a relatively large disturbance stimulus intermittently, plants his/her feet so that his/her feet will not be lifted as a result of the disturbance stimulus, and from this state, returns his/her posture to the natural standing posture.

Depending on the condition of the training person's disease and the progress of rehabilitation training of the training person, one of the above-mentioned two functions may be satisfactory while the other function may need training. Alternatively, in order to recover both of the above-mentioned functions in a well-balanced manner, it may be desired to appropriately divide an amount of training for the above-mentioned two functions. That is, it can be said that the recovery training for the balance function should be performed according to the purpose. To this end, the training apparatus 100 according to this embodiment includes a first mode and a second mode according to the training for recovering the above-mentioned respective functions. The first mode and the second mode will be described below.

Figure 5:
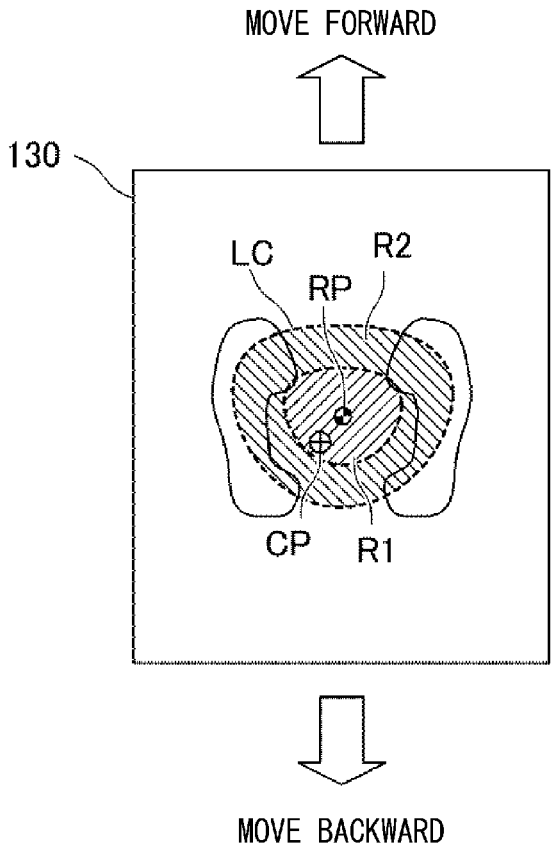
FIG. 5 is a diagram for explaining a first range and a second range.

FIG. 5 shows a first range R1 and a second range R2. The first range R1 is a range set inside the stable range LC, and the second range R2 is a range set outside the first range R1 inside the stable range LC. For example, a boundary line of the first range R1 is set to be ½ of the boundary line of the stable range LC with the reference position RP at the center. An outer peripheral boundary line of the second range R2 conforms to the boundary line of the stable range LC. Each boundary line may be set according to the state of the training person 900, in addition to being reduced or enlarged according to the status, which will be described later.

When the first mode is selected, the movement control unit 203 drives the driving wheels 121 under drive control in which the load's center of gravity CP of the training person 900 is predicted to shift within the first range R1. Alternatively, when the second mode is selected, the movement control unit 203 drives the driving wheels 121 under drive control in which the load's center of gravity CP of the training person 900 is predicted to shift to the second range.

Figure 6:
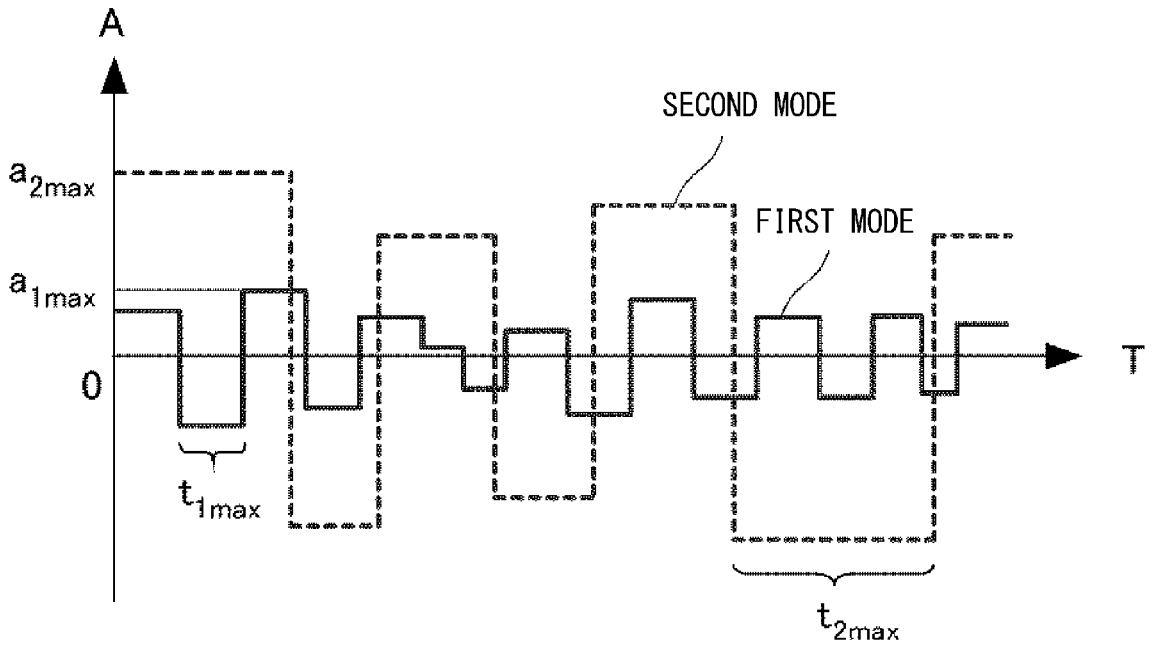
FIG. 6 is a diagram for explaining acceleration control performed in each mode by a movement control unit.

Specific drive control will be described. FIG. 6 is a diagram for explaining acceleration control performed by the movement control unit 203 in each mode. The horizontal axis represents the time elapsed, and the vertical axis represents target acceleration to be generated in the moving carriage 110. The solid line indicates acceleration control performed by the movement control unit 203 when the first mode is selected, and the dotted line indicates acceleration control performed by the movement control unit 203 when the second mode is selected.

In the acceleration control in the first mode, maximum acceleration $|a_{1max}|$ as a magnitude of allowable acceleration is set to be relatively small, and a maximum acceleration time $t_{1max}$ as an allowable acceleration time is also set to be relatively short. At least one of the magnitude of acceleration and the acceleration time in the first mode is set to be different front the corresponding one of the magnitude of acceleration and the acceleration time in the second mode. In the acceleration control in the second mode, maximum acceleration $|a_{2max}|$ as a magnitude of allowable acceleration is set to be relatively large as compared with that of the first mode, and a maximum acceleration time $t_{2max}$ as an allowable acceleration time is also set to be relatively long as compared with that of the first mode.

That is, $|a_{1max}|<|a_{2max}|$, and $t_{1max}<t_{2max}$. However, the magnitude of the acceleration and acceleration time in the acceleration control in the second mode may partially conform to the magnitude of the acceleration and acceleration time in the acceleration control in the first mode. In the acceleration control in the second mode, the magnitude of the acceleration may include $|a_{1max}|$ or less, and the acceleration time may include $t_{1max}$ or less.

It can be said that the stable range LC set through a calibration work reflects the current condition of the training person 900's balance function. In other words, it can be said that the balance functions of training persons who have the same stable range LC are common to each other. For this reason, the relationship between the stable range LC and $|a_{1max}|$, $|a_{2max}|$, $t_{1max}$, and $t_{2max}$ can be collected by conducting tests on many training persons. By statistically processing samples from the tests, a lookup table for the stable range LC and $|a_{1max}|$, $|a_{2max}|$, $t_{1max}$, and $t_{2max}$ can be created. The training apparatus 100 stores the lookup table created in this way in the memory 240, and the movement control unit 203 refers to the lookup table to determine $|a_{1max}|$, $|a_{2max}|$, $t_{1max}$, and $t_{2max}$ for the set stable range LC. In addition, a condition and a state in which the training person lifts his/her toes or heels may be detected to determine $|a_{1max}|$, $|a_{2max}|$, $t_{1max}$, and $t_{2max}$ according to the training person's balance ability. Further, during the training of the training person, $|a_{1max}|$, $|a_{2max}|$, $t_{1max}$, and $t_{2max}$ may be gradually changed so that they are corrected to the values optimum for the training person.

Figure 7:
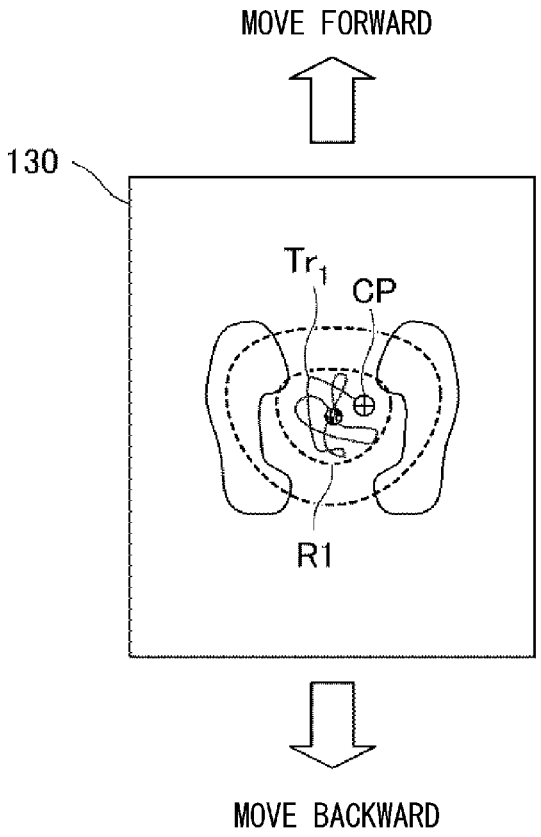
FIG. 7 shows an example of a trajectory of the load's center of gravity in a first mode.

FIG. 7 shows an example of a trajectory $Tr_1$ of the load's center of gravity CP in the first mode. While the moving carriage 110 is controlled in the first mode, the trajectory $Tr_1$ can be expected to be included in the first range R1, as shown in the drawing. It can be expected such training enables the training person to recover the function of keeping the posture so that the training person does not wobble due to an unexpected disturbance stimulus. However, during the training process, the training person may fail adjusting his/her balance, and the load's center of gravity CP may deviate front the first range R1. In such a case, the first range R1 is considered to be wide, and thus the drive control may be corrected so that the first range R1 is narrowed and to correct $|a_{1max}|$ and $t_{1max}$ corresponding to the narrowed first range R1. Conversely, when the trajectory $Tr_1$ remains in a part of a region near the center of the first range R1, it can be said that the training person is stably keeping a natural standing posture without wobbling. In such case, such drive control that expands the first range R1 may be performed.

Figure 8:
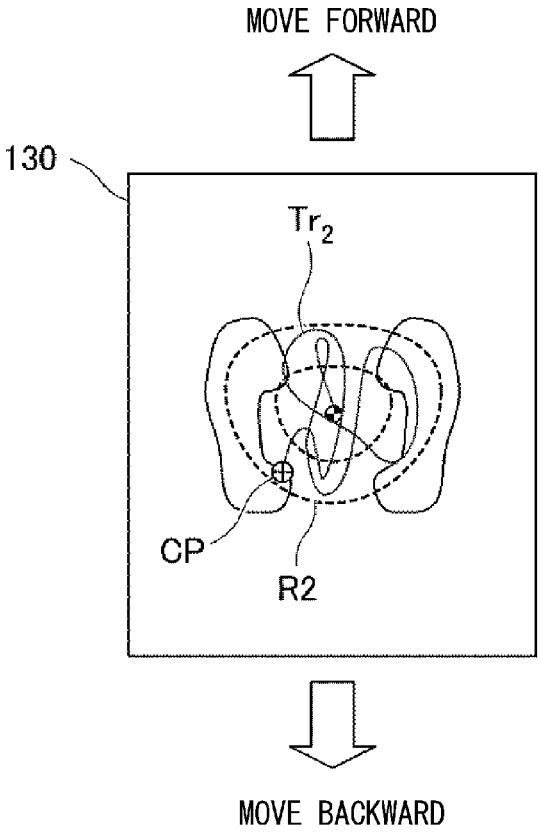
FIG. 8 shows an example of a trajectory of the load's center of gravity in a second mode.

FIG. 8 shows an example of a trajectory $Tr^2$ of the load's center of gravity CP in the second mode. While the moving carriage 110 is controlled in the second mode, the trajectory $Tr_2$ can be expected to cross and move in and out the first range R1 and the second range R2, as shown in the drawing. It is expected that such training enables the training person to recover the function of returning the posture after wobbling due to a strong disturbance stimulus. However, during the training process, the training person may fail adjusting his/her balance, and the load's center of gravity CP may deviate from the second range R2. In such a case, the second range R2 is considered to be wide, and thus the drive control may be corrected so that the second range R2 is narrowed and to correct $|a_{2max}|$ and $t_{2max}$ corresponding to the narrowed second range R2. Conversely, when the trajectory $Tr_2$ remains in a region of the first range R1, it can be said that the training person has not been subjected to a disturbance stimulus to the extent that his/her foot is lifted. In such case, such drive control that expands the second range R2 may be performed.

Figure 9:
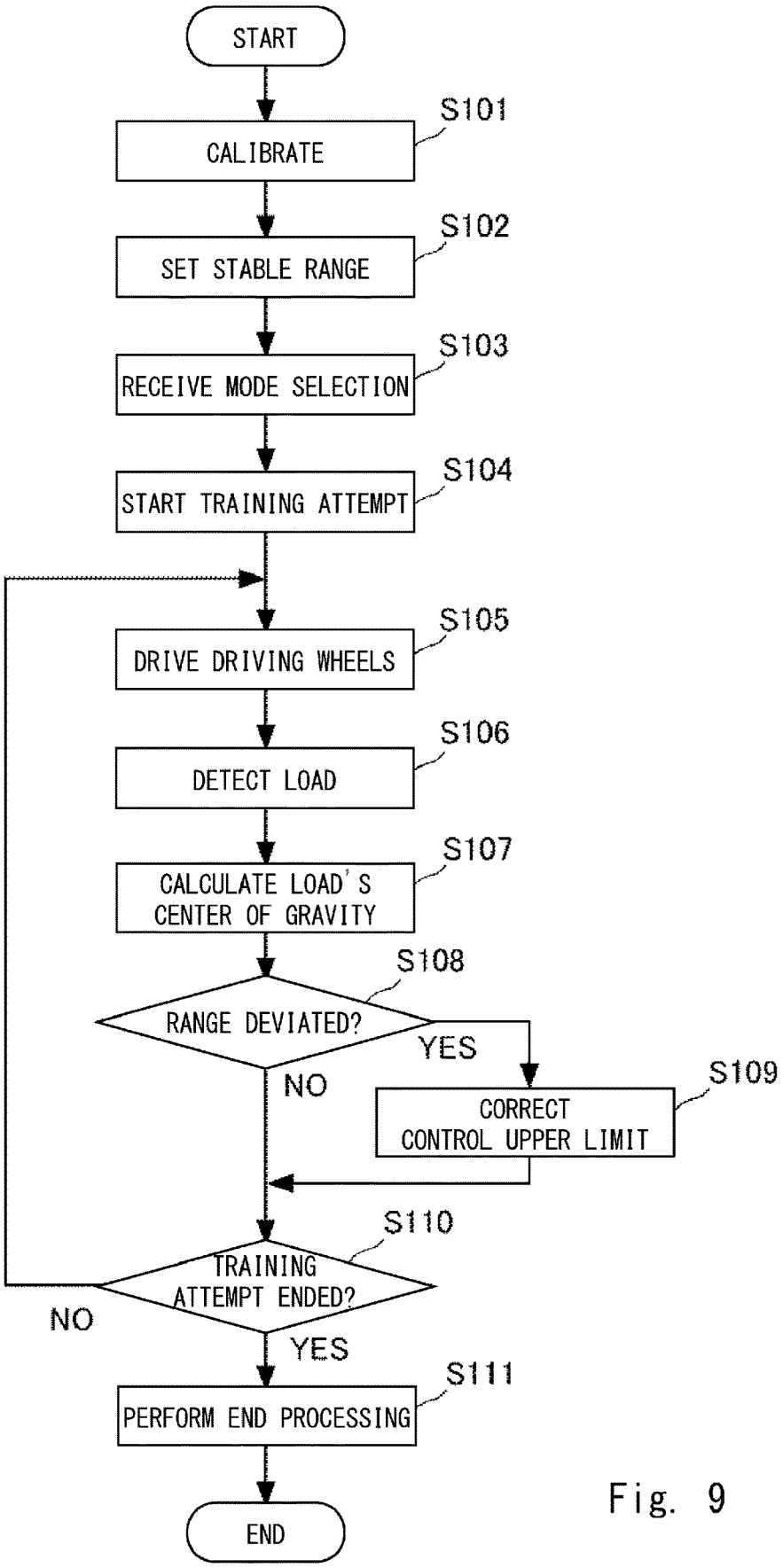
FIG. 9 shows a processing flow of a training attempt.

FIG. 9 is a flowchart showing a processing flow of a training attempt. For example, the flow is started in a state in which the training person 900 has boarded the boarding plate 130. The range setting unit 202 executes calibration in Step S101. Specifically, as described with reference to FIG. 3, the training person 900 is encouraged to perform a calibration work for sequentially shifting his/her center of gravity. For example, the display panel 170 displays "Next, shift your center of gravity to your right foot until right before your left foot is lifted". The load calculation unit 201 receives a detection signal from the load sensor 140 every time the center of gravity is shifted, and sequentially calculates the load's center of gravity $CP_F$, $CP_R$, $CP_B$, and $CP_L$. The range setting unit 202 proceeds to Step S102, and sets the stable range LC from the calculated load's center of gravity $CP_F$, $CP_R$, $CP_B$, and $CP_L$.

In Step S103, the arithmetic processing, unit 200 receives a mode selection for selecting one of the first mode and the second mode via the operation reception unit 220. The mode selection may be performed by the training person 900 or an assistant. Note that this step is omitted when the designated task game corresponds to the first mode or the second mode.

The arithmetic processing unit 200 proceeds to Step S104, reads the designated task game 241 from the memory 240, and starts a training attempt through the task game 241. The arithmetic processing unit 200 displays a video image in accordance with the progress of the task game 241 on the display panel 170 via the display control unit 213.

In Step S105, the movement control unit 203 sets the target acceleration and acceleration time according to the selected mode and the progress of the task game 241. Then, a driving torque corresponding to the set target acceleration is calculated, and a driving signal for outputting the driving torque is transmitted to the driving wheel unit 210 over a set acceleration time. In Step S106, the load sensors 140 detect the load received from the training person 900 feet, and passes the detected detection signal to the load calculation unit 201. In Step S107, the load calculation unit 201 calculates the load's center of gravity from the received detection signal, and passes it to the movement control unit 203.

In Step S108, the movement control unit 203 determines whether the current load's center of gravity deviates from the range corresponding to the mode. When the movement control unit 203 determines that the current load's center of gravity deviates from the range, it corrects the magnitude of acceleration and an upper limit of an acceleration time in Step S109, and then the process proceeds to Step S110. When the movement control unit 203 determines that the current load's center of gravity does not deviate from the range, the process directly proceeds to Step S110.

In Step S110, the arithmetic processing unit 200 determines whether the training attempt has ended. The training attempt ends, for example, when the task game 241 ends, a set period of time elapses, or a target item is achieved. When the arithmetic processing unit 200 determines that the training attempt has not ended, the process returns to Step S105 where the training attempt is continued, whereas when the arithmetic processing unit 200 determines that the training attempt has ended, the process proceeds to Step S111. In Step S111, the arithmetic processing unit 200 executes end processing to end a series of processing. The end processing is to display the final score on the display panel 170 and update history information of the training that has been carried out so far.

In the above-described embodiments, the moving carriage 110 has a structure that moves back and forth, and thus the movement control and task games corresponding to such a structure are employed. However, when the moving carriage 110 has a structure that also moves in the right-left direction, the movement control and task games corresponding to such a structure that moves back and forth and also left and right may be employed. For example, in the example of FIGS. 4A and 4B, the character M is moved in the front-rear direction, the right-left direction, and further the oblique direction in accordance with the progress of the task game 241. In this case, the movement control unit 203 moves the moving carriage 110 in the front-rear direction, the right-left direction, and the oblique direction in synchronization with the swinging of the character M.

In this embodiment described above, the magnitude of the acceleration and the acceleration time applied to the moving carriage 110 are controlled as the movement control corresponding to the first mode and the second mode. However, an object to be controlled is not limited to this. Various objects to be controlled may be selected as long as such drive control that predicts that the load's center of gravity calculated by the calculation unit shifts within the first range and such drive control that predicts that the load's center of gravity shifts to the second range are performed. For example, an object to be controlled may be a position or a speed.

The program can be stored and provided to a computer using any type of non-transitory computer readable media. Non-transitory computer readable media include any type of tangible storage media. Examples of non-transitory computer readable media include magnetic storage media (such as floppy disks, magnetic tapes, hard disk drives, etc.), optical magnetic storage media (e.g. magneto-optical disks), CD-ROM (compact disc read only memory), CD-R (compact disc recordable), CD-R/W (compact disc rewritable), and semiconductor memories (such as mask ROM, PROM (programmable ROM), EPROM (erasable PROM), flash ROM, RAM (random access memory), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A balance training system comprising:

a moving carriage configured to be able to move on a moving surface by driving a driving unit;

a detection unit configured to detect a load received from a training person's feet standing on the moving carriage;

a calculation unit configured to calculate a load's center of gravity of the training person's feet on a boarding surface from the load detected by the detection unit;

a setting unit configured to set a stable range, the stable range being a range of the load's center of gravity, and the training person is estimated to maintain upright on the boarding surface in the range; and a control unit configured to drive the driving unit and control movement of the moving carriage in a mode selected between a first mode and a second mode, in the first mode, the driving unit being driven under drive control predicting that the load's center of gravity calculated by the calculation unit shifts within a first range set inside the stable range, and in the second mode, the driving unit being driven under drive control predicting that the load's center of gravity calculated by the calculation unit shifts to a second range set outside the first range inside the stable range.

2. The balance training system according to claim 1, wherein at least one of a magnitude of acceleration and an acceleration time applied to the moving carriage in the drive control in the first mode is set to be different from corresponding one of a magnitude of acceleration and an acceleration time applied to the moving carriage in the drive control in the second mode.

3. The balance training system according to claim 1, wherein when the load's center of gravity calculated by the calculation unit deviates from the first range while the control unit drives the driving unit in the first mode, the control unit is configured to narrow the first range to correct the drive control.

4. The balance training system according to claim 1, wherein when the load's center of gravity calculated by the calculation unit deviates from the second range while the control unit drives the driving unit in the second mode, the control unit configured to narrow the second range to correct the drive control.

5. The balance training system according to claim 1, further comprising a selection unit configured to select one of the first mode and the second mode prior to a training attempt.

6. The balance training system according to claim 1, wherein the setting unit is configured to set the stable range based on the load's center of gravity calculated by the calculation unit in a calibration work performed by the training person prior to the training attempt.

7. A balance training system comprising:

a moving carriage configured to be able to move on a moving surface by driving a driving unit;

a sensor configured to detect a load received from a training person's feet standing on the moving carriage; and a processor configured to calculate a load's center of gravity of the training person's feet on a boarding surface from the load detected by the sensor, to set a stable range, the stable range being a range of the load's center of gravity, and the training person is estimated to maintain upright on the boarding surface in the range, and to drive the driving unit and control movement of the moving carriage in a mode selected between a first mode and a second mode, in the first mode, the driving unit being driven under drive control predicting that the calculated load's center of gravity shifts within a first range set inside the stable range, and in the second mode, the driving unit being driven under drive control predicting that the calculated load's center of gravity shifts to a second range set outside the first range inside the stable range.

8. A non-transitory computer readable medium storing a control program for a balance training system for enabling a training person to perform balance training while standing on a moving carriage moving on a moving surface, the control program causing a computer to execute:

setting a stable range, the stable range being a range of a load's center of gravity, and the training person is estimated to maintain upright on a boarding surface in the range; and when the moving, carriage is moved by driving a driving unit, driving the driving unit and controlling movement of the moving carriage in a mode selected between a first mode and a second mode, in the first mode, the driving unit being driven under drive control predicting the load's center of gravity shifts within a first range set inside the stable range, and in the second mode, the driving unit being driven under drive control predicting the load's center of gravity shifts to a second range set outside the first range within the stable range.

* * * * *